United States Patent [19]

Gutman

[11] Patent Number: 4,569,906

[45] Date of Patent: Feb. 11, 1986

[54] FOG SUPPRESSANT FOR PHOTOTHERMOGRAPHIC IMAGING COMPOSITIONS

[75] Inventor: Gustav Gutman, Lake Elmo, Minn.

[73] Assignee: Minnesota Mining and Manufacturing Company, St. Paul, Minn.

[21] Appl. No.: 633,957

[22] Filed: Jul. 24, 1984

[51] Int. Cl.[4] ..... G03C 1/34; G03C 1/02

[52] U.S. Cl. ..... 430/607; 430/618; 430/619; 430/620

[58] Field of Search ..... 430/618, 619, 620, 607

[56] References Cited

U.S. PATENT DOCUMENTS 4,173,482 11/1979 Akashi et al. ..... 430/619

4,211,839 7/1980 Suzuki et al. ..... 430/619

4,346,167 8/1982 Imatomi et al. ..... 430/607

FOREIGN PATENT DOCUMENTS 2023862 1/1980 United Kingdom ..... 430/607

*Primary Examiner*—Won H. Louie

*Attorney, Agent, or Firm*—Donald M. Sell; James A. Smith; David L. Weinstein

[57] ABSTRACT

A thermally developable photosensitive material containing (a) at least one organic silver compound, (b) at least one reducing agent, for said organic silver compound, (c) at least one photosensitive silver halide, and (d) at least one indan or tetralin derivative having at least two carboxyl groups. The indan and tetralin derivatives operate to suppress thermal fog.

5 Claims, No Drawings

FOG SUPPRESSANT FOR PHOTOTHERMOGRAPHIC IMAGING COMPOSITIONS

BACKGROUND OF THE INVENTION

The present invention relates to a thermally developable, photosensitive material, and particularly to a thermally developable, photosensitive material which does not require the presence of mercury to suppress fogging.

A variety of methods which comprise subjecting photographic materials containing photosensitive components such as silver halide or the like to a so-called dry processing by heating to thereby obtain an image are known. Of these photosensitive materials which can form photographic images using dry processing, the most common one is a thermally developable, photosensitive material as described in U.S. Pat. Nos. 3,152,904, 3,457,075, 3,707,377 and 3,909,271, in which an oxidation-reduction image forming composition comprising, as essential components, organic silver salt oxidizing agents (for example, silver behenate), photocatalysts such as photosensitive silver halide, and reducing agents (for example, 2,2'-methylenebis [4-methyl-6-t-butyl] phenol), is utilized. While the thermally developable, photosensitive material is stable at ambient temperature, after exposure to light, the organic silver salt oxidizing agent and reducing agent present in the photosensitive layer undergo, when heated generally at temperatures of higher than about 80° C., preferably greater than about 100° C., an oxidation-reduction reaction due to the catalytic action of the photocatalyst which is present in proximity to the organic silver salt oxidizing agent and reducing agent to thereby form silver. The exposed areas of the photosensitive layer are rapidly darkened so that a contrast is formed between the unexposed areas (background) to form an image.

Mercury, in the form of mercuric salts such as mercuric bromide or mercuric acetate, is generally included in the thermally developable, photosensitive material to suppress background darkening or fog upon processing. Birkeland, U.S. Pat. No. 3,589,903 discloses that by incorporating mercuric ion in a light-sensitive heat-developable imaging sheet containing catalytic amounts of light-sensitive silver halide in catalytic association with organic silver salt oxidation-reduction image-forming means, the sheet is given increased speed, stability and contrast. Ulbing, U.S. Pat. No. 3,692,526 discloses that a combination of a mercury salt, such as a mercury halide with thiourea dioxide in a heat-processable photosensitive element, composition and/or process provides reduced background print-out. When the mercury salt, e.g., mercuric chloride, or thioruea dioxide is used alone in the absence of the combination, no satisfactory image is produced.

It is well known that excessive exposure to mercury can result in corrosive effects on skin and mucous membranes, nausea, vomiting, abdominal pain, and kidney damage. Elimination of at least a portion of the mercury from paper and film would be beneficial to those involved in the manufacturing process and to the environment after disposal. Accordingly, it would be highly desirable to provide an additive to photothermographic elements which would prevent fog formation but not be toxic to humans or to the environment.

SUMMARY OF THE INVENTION

This invention involves a thermally developable, photosensitive material containing (a) at least one organic silver salt oxidizing agent, (b) at least one photosensitive silver halide, (c) at least one reducing agent for silver ion, and further containing (d) at least one indan or tetralin derivative, said derivative having at least two carboxyl groups, e.g. 1,1,3-trimethyl-5-carboxyl-3-(p-carboxyphenyl)indan. The indan or tetralin derivative makes it possible to significantly reduce, or even completely eliminate, the level of mercury in the thermally developable, photosensitive material, while greatly reducing thermal fog resulting from heat development of the exposed photosensitive material. In addition, environmental requirements can be satisfied and workers will not come in contact with excessive levels of mercury.

DETAILED DESCRIPTION

The indan and tetralin derivatives suitable for the compositions of this invention must have at least two carboxyl groups.

The class of indan derivatives can be represented by the structural formula

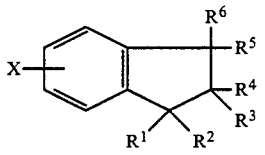

and the class of tetralin derivatives can be represented by the structural formula

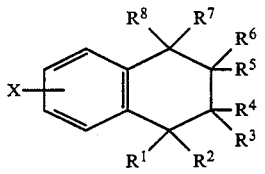

wherein $R^1$, $R^2$, $R^3$, $R^4$, $R^5$, $R^6$, $R^7$, $R^8$ independently represent hydrogen, alkyl group having 1 to 4 carbon atoms, —COOH or —RCOOH where R represents an alkyl group or an aryl group, said alkyl group having from 1 to 4 carbon atoms, said aryl group having 1 or 2 rings, and X represents —COOH.

The compound preferred for use in the present invention is 1,1,3-trimethyl-5-carboxyl-3-(p-carboxyphenyl-)indan. This compound can be represented by the formula:

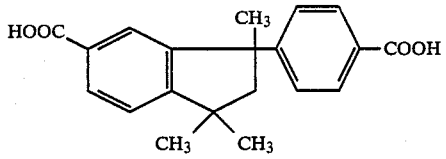

This compound can be prepared by the method described by Alfred Steitz, Jr. and James O. Knobloch in *Journal of Paint Technology,* Vol. 40, No. 524, September 1968, pp. 384–388. A sufficient amount of indan or tetralin derivative should be added to the composition so that thermal fog will be suppressed but so that sensitivity and gamma will not be reduced. The amount of indan or tetralin derivative should range from 0.5 to 20 percent by weight, preferably 1 to 15 percent by weight, more preferably 5 to 10 percent by weight, based on the weight of oxidizing agent in the photosensitive material.

The fog suppressant of the present invention is useful with photothermographic systems that comprise the following ingredients applied to a suitable support:

(a) photosensitive silver halide prepared in situ or ex situ, (b) an oxidation-reduction image-forming combination comprising:

(i) a silver salt or complex of an organic compound as an oxidizing agent, and (ii) an organic reducing agent or developing agent, and (c) a vehicle or binder.

Photothermographic emulsions are usually constructed as one or two layers on a substrate. Single layer constructions must contain the oxidizing agent, the photosensitive silver halide, the organic reducing or developing agent, and binder, as well as optional additional materials such as toners, coating aids and other adjuvants. Two-layer constructions must contain the oxidizing agent and silver halide in one emulsion layer (usually the layer adjacent the substrate) and the other ingredients in the second layer or both layers.

Photosensitive silver halide can be generated in situ throughout the surface of the coating of the organic silver salt or complex, or it can be added as a preformed material. U.S. Pat. No. 3,457,075, incorporated herein by reference, describes formation of photosensitive silver halide by an in situ process. U.S. Pat. No. 3,871,887, incorporated herein by reference, describes addition of preformed photosensitive silver halide to a photothermographic imaging composition.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 to 25 percent are useful. It is preferred to use from 1 to 10 percent by weight silver halide in the imaging layer and most preferred to use from 1.5 to 7.0 percent.

Oxidizing agents (b)(i) suitable for the practice of the present invention include silver salts of long chain fatty carboxylic acids having 10 to 30 carbon atoms, silver salts of organic compounds have 6 to 24 carbon atoms and containing an imino group, and silver salts of organic compounds having 4 to 10 carbon atoms and containing a mercapto group or a thione group. Specific examples of such oxidizing agents include silver behenate, silver arachidate, silver nonadecanoate, silver stearate, silver heptadecanoate, silver palmitate, silver laurate, silver saccharinate, 5-substituted salicyladoxime silver salt, benzotriazole silver salt, phthalazinone silver salt, 3-mercapto-4-phenyl-1,2,4-triazole silver salt, and the like. Silver behenate and silver arachidate are the most suitable. The above-mentioned oxidizing agents may be used alone or in mixture.

The oxidizing agent should constitute from about 20 to 70 percent by weight of the imaging layer. Preferably it is present as 30 to 55 percent by weight. The second layer in a two-layer construction would not affect the percentage of the oxidizing agent desired in the single imaging layer.

The reducing agent for silver ion may be any material, preferably organic material, which will reduce silver ion to metallic silver. Organic reducing agents (b)(ii) suitable for the practice of the present invention include substituted or unsubstituted bisphenols, substituted or unsubstituted naphthols, di- or polyhydroxybenzenes, hydroquinone ether, ascorbic acids are its derivatives, 3-pyrazolidones, pyrazoline-5-ones, reducing sugars and the like. Specific examples of such reducing agents include hydroquinone, methylhydroquinone, chlorohydroquinone, bromohydroquinone, phenylhydroquinone, t-octylhydroquinone, t-butylhydroquinone, 2,5-dimethylhydroquinone, 2,6-dimethylhydroquinone, methoxyhydroquinone, methoxyphenol, hydroquinone monobenzyl ether, catechol, pyrogallol, resorcin, p-aminophenol, 2,4,4-trimethylpentyl-bis(2-hydroxy-3,5-dimethylphenyl)methane, bis(2-hydroxy-3-t-butyl-5-methylphenyl)methane, bis(2-hydroxy-3,5-di-t-butylphenyl)methane, 4,4'-methylenebis(2-methyl-6-t-butylphenol), 4,4'-methylenebis(2,6-di-t-butylphenol), 2,2'-methylenebis(6-t-butyl-4-ethoxyphenol), methylhydronaphthalene, phenidone, methyl gallate, lactose, ascorbic acid and the like. The above-mentioned reducing agents may be alone or in mixture. A suitable reducing agent may be chosen depending on the organic silver salt oxidizing agent employed in combination therewith. For example, when there is employed as the oxidizing agent a long chain fatty acid silver salt such as silver behenate which is relatively hard to reduce, relatively strong reducing agents, e.g. a bisphenol such as 2,2'-methylenebis(4-methyl-6-t-butyl)phenol, are preferably employed. On the other hand, with organic silver salt oxidizing agents such as silver laurate which are relatively easy to reduce, relatively weak reducing agents, e.g. substituted phenols such as p-phenylphenol, are preferably employed. With organic silver salt oxidizing agents such as benzotriazole silver salt which is very hard to reduce, stronger reducing agents such as ascorbic acids are preferably employed. The reducing agent should be present as 1 to 10 percent by weight of the imaging layer. In a two-layer construction, if the reducing agent is in the second layer, slightly higher proportions, of from about 2 to 15 percent tend to be more desirable.

Binders (c) suitable for the practice of the present invention may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of each layer, and preferably about 30 to 55 percent by weight.

The support has to be stable at processing temperatures between 60° and 150° C. Suitable supports include sheets or foils of a paper, cellulose acetate, polyethylene terephthalate, fabric, metal foils, and glass. In the case of a paper support, the paper may carry the usual auxiliary layers such as baryta coatings, polyethylene coatings, and the like.

The system can also comprise other conventional photographic addenda, for example, toners, spectral sensitizing dyes, development modifiers, auxiliary reducing agents, coating aids, image stabilizers, activators, image stabilizers precursors, and the like. Toners such as phthalazinone, phthalazine and phthalic acid are not essential to the construction, but are highly desirable. These materials may be present, for example, in amounts of from 0.2 to 5 percent by weight. Compounds containing mercury can also be added to the system. Generally, as more of the indan or tetralin derivative is added to photothermographic composition, a higher level of mercury-containing compound can be removed.

The following non-limiting examples will further illustrate this invention.

EXAMPLE I

A photosensitive composition was prepared by the following procedure:

Homogenate of silver behenate (half soap) (120 g) was mixed with 54 g toluene for 15 minutes. Polyvinyl butyral solution (3 ml of solution of 6.25 g/100 ml methanol) were added to the mixture, and the resulting mixture was stirred for 15 minutes. Polyvinyl butyral (20 g) was then added to the mixture. The resulting mixture was stirred for an additional 15 minutes. A dye solution (6 ml) consisting of 0.25 g Dye I[1] and 0.25 g Dye II[2] in 500 ml methanol was added to the mixture. The resulting mixture was stirred for 50 minutes. The mixture was denoted as Solution A.

[1] Dye I is represented by the formula

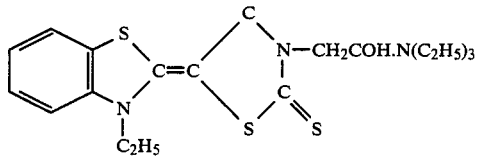

[2] Dye II is represented by the formula

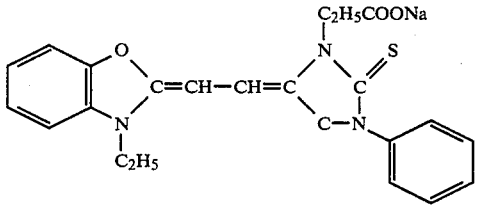

The following ingredients in the amounts indicated were introduced into a breaker with stirring.

| Ingredient | Amount (g) |
|---|---|
| Acetone | 66.0 |
| Methyl ethyl ketone | 13.6 |
| Methanol | 9.4 |
| Silica | 0.6 |
| Cellulose acetate | 6.7 |
| Phthalazine | 0.34 |
| Phthalic acid | 0.3 |
| Tetrachlorophthalic acid anhydride | 0.25 |
| 1,1 Bis(2-hydroxy-3-t-butyl-5-methyl phenyl) methane | 4.50 |

-continued

| Ingredient | Amount (g) |
|---|---|
| 1,1,3-Trimethyl-5-carboxyl-3-(p-carboxyphenyl)indan | as indicated in Table I |

This mixture was denoted as Solution B.

TABLE I

| Run No. | Amount of 1,1,3-trimethyl-5-carboxyl-3-(p-carboxyphenyl)indan (% of Solution B) |
|---|---|
| 1 | 0 |
| 2 | 0.05 |
| 3 | 0.10 |
| 4 | 0.20 |

Solution A was coated on a paper substrate at an orifice opening of 2 mil. The coating was dried for 5 min. at 175° F. (80° C.).

Solution B was coated over the dried coating prepared from Solution A at an orifice opening of 2.25 mil. The coating prepared from Solution B was dried for 5 min. at 175° F. (80° C.).

Each sample was exposed with a tungsten light source through a continuous wedge at a level of 10,000 meter candle seconds. The exposed samples were developed for 3 seconds at 268° F. (131° C.). The results are shown in Table II.

TABLE II

| Run No. | Dmin | Dmax | Speed point* | Gamma° |
|---|---|---|---|---|
| 1 | 0.26 | 1.50 | 2.21 | 64.9 |
| 2 | 0.13 | 1.56 | 2.43 | 62.9 |
| 3 | 0.11 | 1.57 | 2.42 | 61.5 |
| 4 | 0.06 | 1.55 | 2.91 | 50.1 |

*Speed point represents the logarithm of the amount of exposure necessary to obtain an optical density of fog +0.6.

The data in Table II show that addition of 1,1,3-trimethyl-5-carboxyl-3-(p-carboxyphenyl)indan reduces Dmin. This result indicates that thermal fog is effectively suppressed.

Although the indan derivative was introduced in the topcoat in the foregoing example, it can also be introduced in the coating containing the organic silver salt.

EXAMPLE II

Example I can be repeated with the sole difference being that an equivalent amount of 1,2,3,4-tetrahydro-1,8-naphthalenedicarboxylic acid is used in lieu of 1,1,3-trimethyl-5-carboxyl-3-(p-carboxyphenyl)indan.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A heat-developable, photosensitive sheet material containing an image-forming system including at least one photosensitive silver halide catalyst or photosensitive silver-halide catalyst-forming component, and as heat image forming means, at least one organic silver compound and at least one reducing agent therefor, the oxidation-reduction reaction of which to produce a visible image is accelerated by said catalyst, said image-forming system further containing at least one indan derivative in an amount sufficient to reduce thermal fog, said indan derivative is represented by the structural formula:

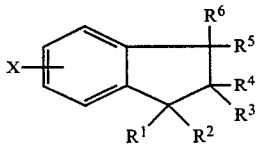

wherein $R^1$, $R^2$, $R^3$, $R^4$, $R^5$, $R^6$ independently represent hydrogen, alkyl group having 1 to 4 carbon atoms, —COOH or —RCOOH where R represents an alkyl group or an aryl group, said alkyl group having from 1 to 4 carbon atoms, said aryl group having 1 or 2 rings, and X represents —COOH, wherein said indan derivative contains at least two carboxyl group.

2. A heat-developable, photosensitive sheet material containing an image-forming system including at least one photosensitive silver halide catalyst or photosensitive silver-halide catalyst-forming component, and as heat image forming means, at least one organic silver compound and at least one reducing agent therefor, the oxidation-reduction reaction of which to produce a visible image is accelerated by said catalyst, said image-forming system further containing at least one tetralin derivative in an amount sufficient to reduce thermal fog, said tetralin derivative is represented by the structural formula:

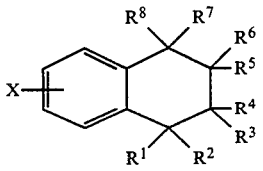

wherein $R^1$, $R^2$, $R^3$, $R^4$, $R^5$, $R^6$, $R^7$, $R^8$ independently represent hydrogen, alkyl group having 1 to 4 carbon atoms, —COOH or —RCOOH where R represents an alkyl group or an aryl group, said alkyl group having from 1 to 4 carbon atoms, said aryl group having 1 or 2 rings, and X represents —COOH, wherein said tetralin derivative contains at least two carboxyl groups.

3. The article of claim 1 wherein said derivative is 1,1,3-trimethyl-5-carboxyl-3-(p-carboxyl phenyl)indan.

4. The article of claim 2 wherein said derivative is present in a concentration of from about 0.05 to about 20 percent by weight, based on the weight of said at least one organic silver compound.

5. The article of claim 2 wherein said derivative is present in a concentration of from about 0.05 to about 20 percent by weight, based on the weight of said at least one organic silver compound.

* * * * *

UNITED STATES PATENT AND TRADEMARK OFFICE

CERTIFICATE OF CORRECTION

PATENT NO. : 4,569,906

DATED : February 11, 1986

INVENTOR(S) : GUSTAV GUTMAN

It is certified that error appears in the above-identified patent and that said Letters Patent is hereby corrected as shown below:

Col. 4, line 13 "are" should read --or--.

Col. 5, line 7 "stabilizers" should read --stabilizer--.

Signed and Sealed this

*Twenty-ninth* Day of *April 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,569,906

DATED : February 11, 1986

INVENTOR(S) : Gustav Gutman

It is certified that error appears in the above-identified patent and that said Letters Patent is hereby corrected as shown below:

Column 8, line 28, "0.05" should read --0.5--.

Signed and Sealed this

Tenth Day of January, 1989

*Attest:*

DONALD J. QUIGG

*Attesting Officer*

*Commissioner of Patents and Trademarks*